United States Patent [19]

Leiter

[11] Patent Number: 4,771,501

[45] Date of Patent: Sep. 20, 1988

[54] BRUSH HOLDER

[76] Inventor: Thomas E. Leiter, 131 Detweiller Dr., Peoria, Ill. 61615

[21] Appl. No.: 28,384

[22] Filed: Mar. 20, 1987

[51] Int. Cl.[4] ..... B08B 3/04

[52] U.S. Cl. ..... 15/104.92; 15/142; 15/257.05; 206/209; 206/361; 206/362; 220/90; 401/121; 401/131

[58] Field of Search ..... 206/15.3, 209, 361, 206/362; 220/90; 15/142, 257.05, 104.92; 401/121, 131; 134/182, 201

[56] References Cited

U.S. PATENT DOCUMENTS

| | | | |
|---|---|---|---|
| 834,721 | 10/1906 | Greve | 206/209 |
| 1,285,948 | 11/1918 | Cook | 206/209 X |
| 2,273,959 | 2/1942 | Holzer | 206/209 |
| 2,827,647 | 3/1958 | Speer | 15/142 X |
| 2,827,648 | 3/1958 | Geisz | 15/257.05 |
| 3,393,412 | 7/1968 | Wrbican | 206/209 X |

FOREIGN PATENT DOCUMENTS

| | | | |
|---|---|---|---|
| 2319727 | 10/1973 | Fed. Rep. of Germany | 206/209 |
| 263451 | 12/1926 | United Kingdom | 15/142 |

*Primary Examiner*—Philip R. Coe
*Attorney, Agent, or Firm*—Berman, Aisenberg & Platt

[57] ABSTRACT

A paintbrush holder having a container and a closely fitting lid has a support for a brush parallel to an inclined wall of the container. The container is filled with solvent fluid to above the level of the brush support which is preferably a comb through which the bristles of the brush are drawn to remove the paint. Tines of the comb extend in a direction projecting from the plane of the inclined wall. The brush is supported for storage parallel to the inclined wall, with the bristles away from collected sediment.

15 Claims, 2 Drawing Sheets

BRUSH HOLDER

FIELD OF THE INVENTION

The invention relates to paint brush cleaning devices.

BACKGROUND OF THE INVENTION

The problem of cleaning paint brushes is well-known, but the prior art has not been able to provide a simple, closable brush holder and cleaner in which the brush may readily be cleaned in the container and supported for storage in the closed container with the bristles covered by fluid but away from the sediment.

In U.S. Pat. No. 4,436,217, apparatus is provided for supporting a paint brush either inside or outside a paint container, but without any provision for cleaning the brush. The brush holder of U.S. Pat. No. 4,116,332 is designed for holding the brush immersed in a paint container in order to obviate the need for cleaning it between uses. There is no provision for brush cleaning. Buslik, U.S. Pat. No. 3,955,670, provides a brush-holding lid for a container of cleaning solvent in which the brush is taped to an opening in the lid. U.S. Pat. No. 3,918,582 provides a cylindrical container for paint brush cleaning fluid, adapted for cleaning a paint roller cover or paint brushes, in which the paint brush or roller cover is suspended from a rod. U.S. Pat. No. 3,393,412 provides a series of barbed needle-like members extending from the base of a container, for expediting the removal of dried paint from paint brushes.

McGrath, U.S. Pat. No. 3,252,613, shows a painter's kit in which removal of excess paint from the brush and its return to the can is facilitated. U.S. Pat. No. 2,908,026 shows a method of resting a brush on an inclined wall, dipped into cleaning solvent. The container is not closed, thereby allowing noxious vapors from the solvent to escape to the atmosphere. U.S. Pat. No. 2,782,909 shows a paint brush storage device in which the brush is supported while immersed in solvent, but no means for cleaning the bristles of the brush is shown. Similarly Switzer, U.S. Pat. No. 2,776,050, shows a brush suspended in cleaning fluid without any means for cleaning the bristles. Olsen, U.S. Pat. No. 1,851,521, shows a brush held by three piercing elements which pass through the handle of the brush.

None of the patents described above discloses a brush holder in which the bristles may be cleaned by a comb which then supports the brush in the cleaning solvent, above the level of sediment in the bottom of the container.

SUMMARY OF THE INVENTION

A cleaner for a paint brush and a storage holder for a cleaned paint brush is described in which the cleaned brush is suspended above the level of the bottom of the container (where the sediment collects). The surface on which the brush is supported is inclined, both to allow economy in the amount of solvent needed, and to provide a "toe" portion in the container in which the sediment collects when the supernatant solvent fluid is decanted. The brush may be drawn through the tines of a comb, the tines being positioned perpendicular to the inclined wall, and may rest on the comb with the bristles immersed in the cleaning fluid, away from the sediment.

It is an object of the invention to provide a low-cost, efficient, combined brush cleaner and storage container.

DETAILED DESCRIPTION OF THE INVENTION

Figure 1:
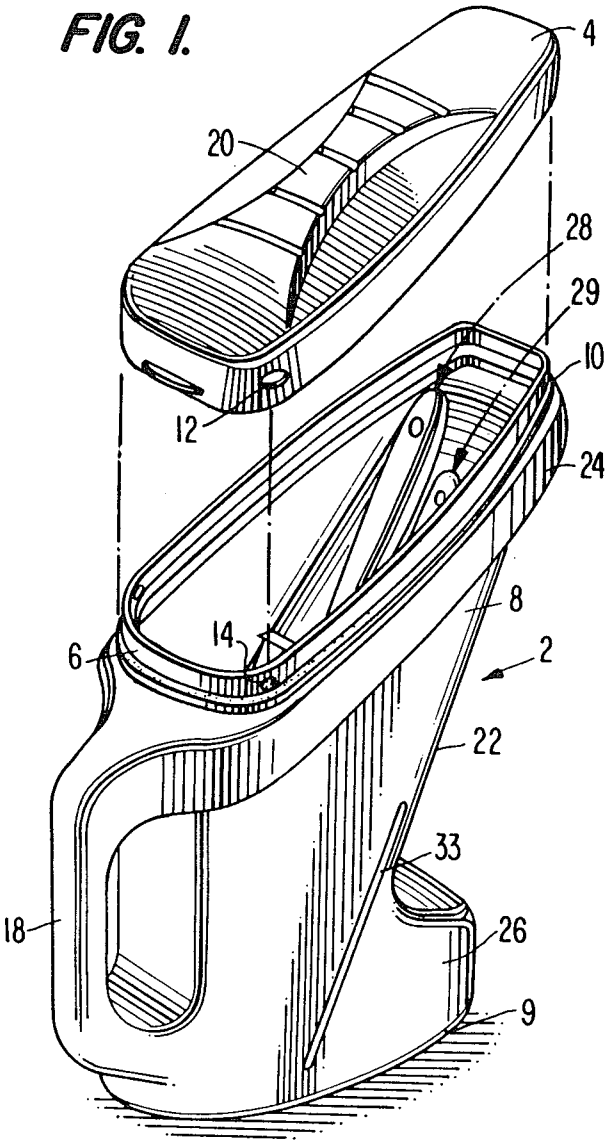
FIG. 1 is an exploded perspective view of a brush holder and lid of the invention.

Referring to FIGS. 1–5, in which like numerals represent like parts, FIG. 1 shows a brush holder 2 of the invention. Lid 4 fixes tightly on container 8 and engages gasket 10 which extends around the perimeter of neck 6 of container 8. Gasket 10 is a large diameter O-ring made of compressible material such as rubber or plastic. Protrusions 12 on lid 4 correspond to, and engage with, protrusions 14 on neck 6 of container 8. Tabs may also be provided on the lid to facilitate its removal. Handle 18 on container 8 allows easy transporting of the container, and handle 20 on lid 4 enables the lid to be more readily put on and taken off. Container 8 is configured with inclined wall 22 connecting top portion 24 and bottom portion 26 of the container.

Figure 2:
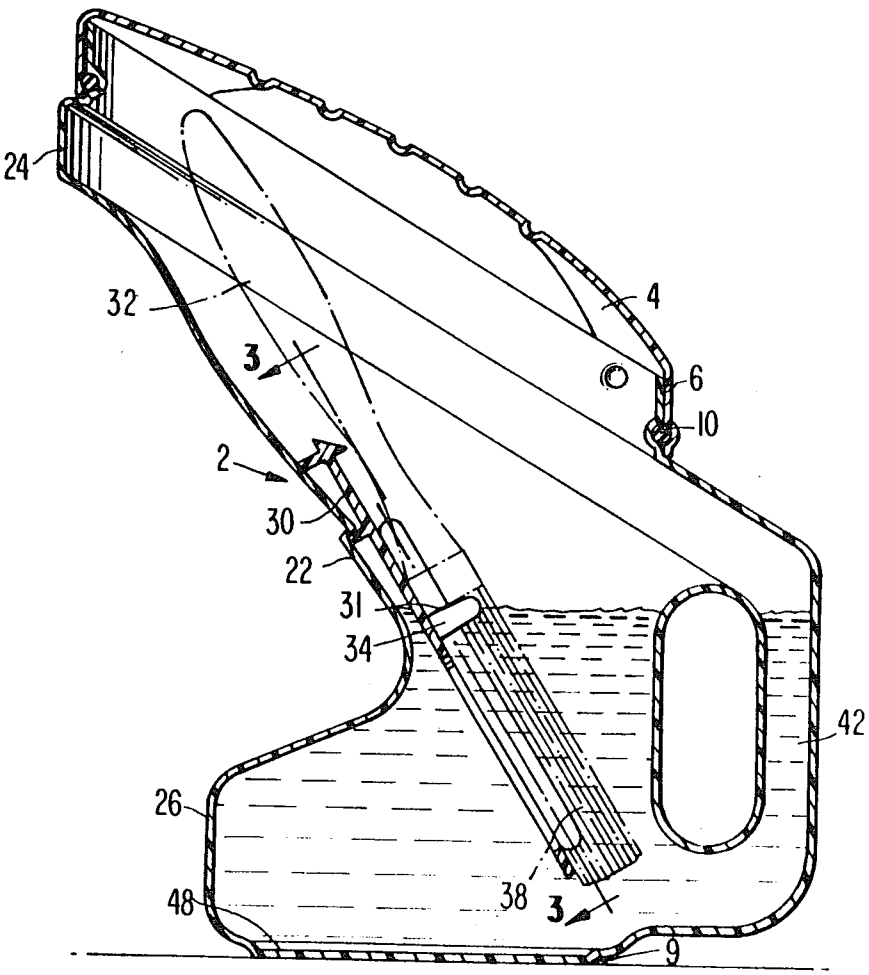
FIG. 2 is a vertical cross-sectional view of a closed brush holder of the invention.
Figure 3:
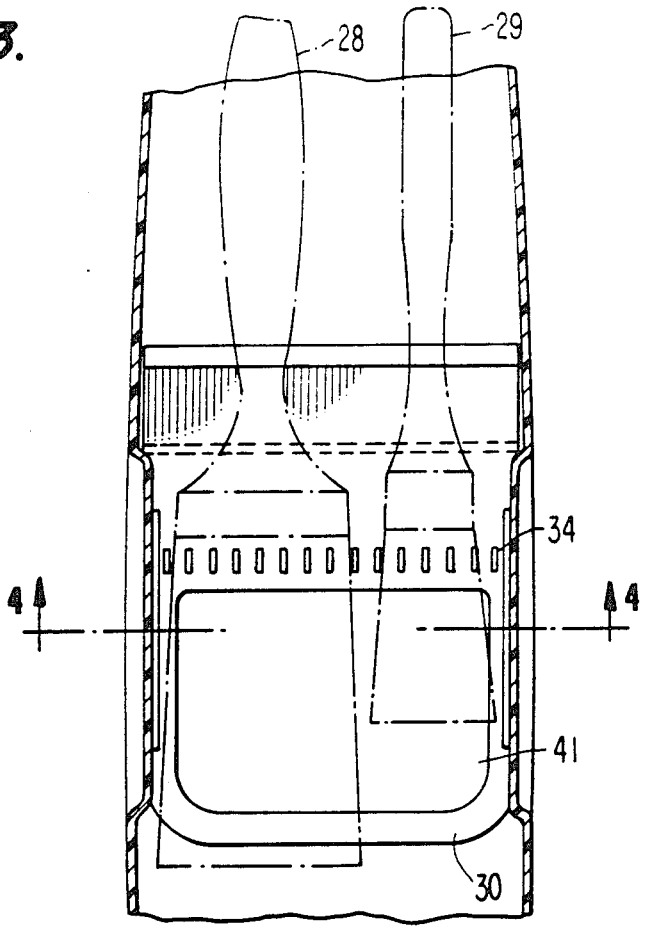
FIG. 3 is cross-section taken on line 3—3 of FIG. 2.
Figure 4:
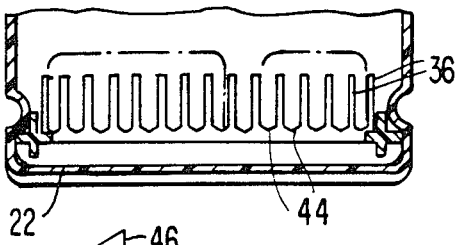
FIG. 4 is a cross-section taken on line 4—4 of FIG. 3.
Figure 5:
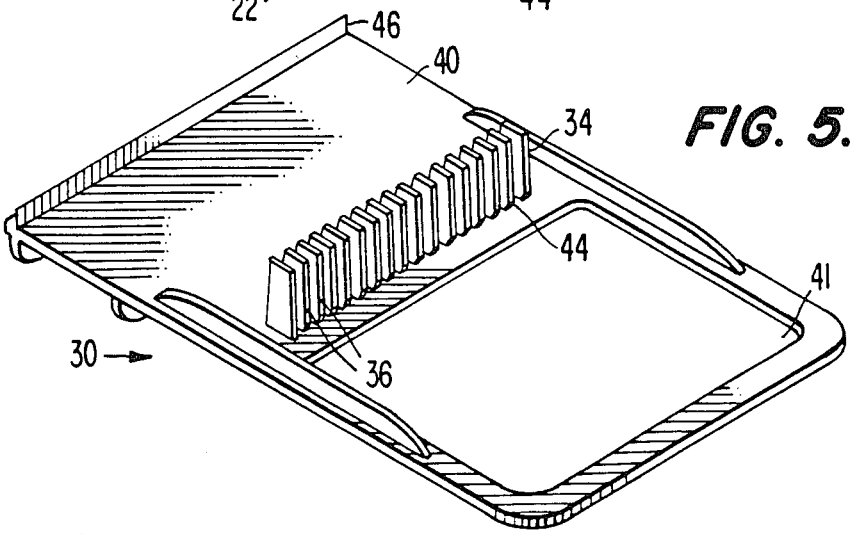
FIG. 5 is a perspective view of a comb used in a brush holder of the invention.

Referring to FIG. 2, which shows brush holder 2 in cross-section, lid 4 is engaged on container 8, the lid fitting closely over gasket 10 to prevent solvent evaporation. Gasket 10 is preferably a large diameter, flexible O-ring. One or more tabs on the lid may be provided to facilitate removal of the lid. Brush 28 (shown in phantom) is engaged on support 30. Brush 28 rests with base 31 of handle 32 resting on comb 34, a plurality of tines 36 extending between bristles 38. Brush support 30, shown in detail in FIGS. 3–5, is supported by container 8 parallel to inclined wall 22, and brush 28 rests on comb 34 of support 30 parallel to inclined wall 22. While the support may be positioned to hold the brush at an angle other than parallel to the inclined wall, the parallel position is preferred. Support 30 may be engaged with molding 33, which is illustrated as an elongated inclined protrusion into the side of container 8, or support 30 may be free standing on the bottom of the container. When support 30 stands on, or extends to, the bottom of the container, it must be placed so that the bristles of a supported brush rest above collected sediment. The support means may be configured to include an aperture 41 for allowing fluid to flow through the bristles, as shown in FIG. 5, the brush being supported so that the bristles overlie aperture 41, as shown in FIG. 3.

FIG. 5 shows support 30 having tines 36 of comb 34 extending perpendicularly from back 40 of support 30. Opening 41 enables free flow of fluid 42 in the container when the support is engaged in the container, as shown in FIG. 2, with the tines extending in a direction perpendicular to the plane of the inclined wall.

In use, container 8 is filled with fluid, preferably brush-cleaning solvent fluid 42, to an appropriate level, optimally above the level of the comb, completely covering the bristles. Brush 28, which has been used for painting, is immersed in solvent fluid 42, and bristles 38 are drawn through the solvent covered tines 36, the tines frictionally engaging the bristles to loosen the paint, enabling the paint particles to be carried away by the solvent fluid. Tines 36 have V-shaped grooves 44 at the base thereof, which facilitate removal of paint from the bristles. The bristles are drawn through the cleaning comb while immersed in solvent fluid enabling clean, efficient, removal of paint from the brush. Paint brushes may be stored in the brush holder of the invention, resting on the comb, the bristles being covered with cleaning solvent, but suspended above the solid paint particles collected on the bottom of the container. The well-fitting lid prevents evaporation of solvent fluid from the container allowing the cleaned brush to remain soft, flexible, and ready for use. Support 30 further includes edge 46 extending across the support, for scraping excess solvent fluid from the brush before removing the brush from the container.

While support 30 is conveniently made as a separate part inserted within the container, it is equally within the scope of the invention that the features of the support, such as tines 36 and/or scraping edge 46 may be molded as part of container 8 so that a separate support unit is not needed.

Comb 34 optimally extends across the width of container 8, but may be narrower if desired. The width may be such as to accept two brushes 28, 29, side-by-side, or one brush of any size which fits within the width of container 8. When brushes are cleaned in the fluid, paint particles removed by the solvent fluid will gravitate to the bottom of the container and collect as sediment 48.

At appropriate intervals, solvent fluid 42, from which the solid paint particles have settled out, may be decanted from the container for reuse, leaving paint sediment 48 in "toe" 26, at the bottom of container 8. The angular configuration of the walls forming the lower part 26 of container 8 prevents sediment 48 from contaminating fluid being decanted. Should any particles of sediment 48 be present in fluid being decanted, such particles are likely to be retained by V-shaped grooves 44 and comb 34 as the fluid is poured therethrough.

In container 8, shown in FIGS. 1–2, the length of the perimeter of the wall of container 8 parallel to base 9 at a distance intermediate between base 9 and the upper edge of neck 6 is less than the length of the perimeter of base 9. Thus a "toe" portion is formed adjacent base 9, and at least a section of the wall above toe 26 may be an inclined wall, shown in FIGS. 1–2 as inclined wall 22.

Inclined wall 22 is preferably molded at an angle of 45°–60° with respect to base 9 of the container, which, in addition to allowing easy access to the brushes, enables the brush holders to be nested together for compact storage and shipping. The inclined wall also reduces the amount of solvent fluid needed, compared with a container of constant cross-section, and the container with fluid has a low center of gravity enabling stability and safety in use.

The container is lightweight, simple to use, inexpensive to manufacture, and not easily tipped over (due to its low center of gravity). The container and lid may be blow-molded from plastic and the support may also be of plastic, and may be made by extrusion molding if molded separately from the container. Appropriate methods are known to those skilled in the art, and other materials, for example, metal, may be used for the container and/or support. Due to the low cost of manufacture, the brush holder may be disposed of after a limited period of use, if desired.

The brush holder has been described for use for cleaning paint brushes. It may equally well be used for containing paint, optimally being filled so that the paint does not completely cover the bristles when the brush rests on the comb. The holder, containing paint and a brush supported on the comb, may be closed with the tightly-fitting lid, and left for several hours at least, without the brush or paint becoming hard and unusable.

While the invention has been described above with respect to certain embodiments thereof, it will be appreciated that various changes and modifications may be made without departing from the spirit and scope of the invention.

I claim:

1. A brush holder comprising:

container means for holding fluid, a lower portion of said container means comprising a base, a toe portion for collecting sediment communicating with said container means adjacent said base, an upper portion of said container means comprising an upper edge and means for pouring fluid located above and aligned with the toe portion, wall means upstanding from the perimeter of the base for forming side walls of the container means, wherein the length of the perimeter of the wall means at a distance intermediate between the base and the upper edge of the container means is substantially less than the length of the perimeter of the base, and support means within the container means, for supporting at least one brush, said support means comprising comb means for frictionally engaging bristles of a brush, said comb means comprising tines extending in a direction projecting from the plane of the support means.

2. A holder of claim 1 further comprising lid means for closing said container means.

3. A holder of claim 2 further comprising gasket means engaged around the upper edge of the container means for securely engaging the lid means on the container means.

4. A holder of claim 2 wherein the lid means further comprises tab means for facilitating removal of said lid means.

5. A holder of claim 1 wherein the tines are separated by V-shaped grooves.

6. A holder of claim 1 wherein the support means further comprises means for removal of excess fluid from said brush.

7. A holder of claim 6 wherein the means for removal of excess fluid is an edge extending in a direction projecting from the plane of the support means.

8. A holder of claim 1 wherein the fluid is brush-cleaning fluid.

9. A holder of claim 1 wherein at least a portion of the wall means is inclined with respect to the base means.

10. A holder of claim 1 wherein the inclined portion of the wall means is inclined at an angle of between 45° and 60° to the base of the container.

11. A holder of claim 1 wherein the support means is molded into the container means.

12. A holder of claim 1 wherein the support means comprises aperture means for allowing fluid to flow therethough.

13. A holder of claim 1 wherein the support means further comprises aperture means for allowing fluid to flow therethrough whereby a brush supported on the support means is supported wherein the bristles of the brush overlie the aperture means and wherein the bristles are suspended away from sediment collected in the container means.

14. A holder of claim 1 wherein the pouring means extends outwardly from the container means a greater distance in the same direction than the toe portion extends.

15. A brush holder comprising:

container means for holding fluid, a lower portion of said container means comprising a base, a toe portion for collecting sediment communicating with said container means adjacent said base, an upper portion of said container means comprising an upper edge and means for pouring fluid located above and aligned with the toe portion, wall means upstanding from the perimeter of the base for forming side walls of the container means, wherein the length of the perimeter of the wall means at a distance intermediate between the base and the upper edge of the container means is substantially less than the length of the perimeter of the base, and support means within the container means for supporting at least one brush.

* * * * *